US006074277A

United States Patent [19]

Arai

[11] Patent Number: 6,074,277

[45] Date of Patent: Jun. 13, 2000

[54] POLISHING APPARATUS

[75] Inventor: Hatsuyuki Arai, Kanagawa-ken, Japan

[73] Assignee: SpeedFam Co., Ltd., Japan

[21] Appl. No.: 09/260,403

[22] Filed: Mar. 1, 1999

[30] Foreign Application Priority Data

Apr. 16, 1998 [JP] Japan ..... 10-122905

[51] Int. Cl.[7] ..... B24B 49/00

[52] U.S. Cl. ..... 451/8; 451/41; 451/270; 451/287; 451/294

[58] Field of Search ..... 451/8, 41, 259, 451/270, 285, 287, 294

[56] References Cited

U.S. PATENT DOCUMENTS

| | | | |
|---|---|---|---|
| 3,841,031 | 10/1974 | Walsh | 451/41 |
| 5,134,807 | 8/1992 | Keefe | 451/259 |
| 5,503,592 | 4/1996 | Neumann | 451/41 |
| 5,733,175 | 3/1998 | Leach | 451/270 |

FOREIGN PATENT DOCUMENTS 9-36072 2/1997 Japan .

*Primary Examiner*—M. Rachuba
*Attorney, Agent, or Firm*—Wall Marjama Bilinski & Burr

[57] ABSTRACT

A polishing apparatus prevents uneven wear of the platen and improves the operating rate of the apparatus. The polishing apparatus provided with a platen 1 divided into an inner peripheral platen portion 11 and an outer peripheral platen portion 13 and with a carrier 5, wherein by making the inner peripheral platen portion 11 and the outer peripheral platen portion 13 rotate in opposite directions and setting the rotational speeds of the inner peripheral platen portion 11 and the outer peripheral platen portion 13 so that the mean relative speed of a wafer 200 and the inner peripheral platen portion 11 and the mean relative speed of the wafer 200 and the outer peripheral platen portion 13 become substantially equal, it becomes possible to make the amount of wear of the polishing pad 11*a* of the inner peripheral platen portion 11 and the amount of wear of the polishing pad 13*a* of the outer peripheral platen portion 13 substantially equal. Preferably, the wafer 200 is made to oscillate so that the wafer 200 overhangs from the inner edge of the inner peripheral platen portion 11 and the outer edge of the outer peripheral platen portion 13.

5 Claims, 7 Drawing Sheets

POLISHING APPARATUS

BACKGROUND OF THE INVENTION

1. Field of the Invention

The present invention relates to a polishing apparatus for polishing a wafer or other workpiece held by a carrier using a rotating platen.

2. Description of the Related Art

In the past, as this type of polishing apparatus, there has been a chemical mechanical polishing (CMP) apparatus.

FIG. 10 is a sectional view of a CMP apparatus.

In FIG. 10, reference numeral 100 indicates a platen comprised of a disk having a polishing pad 101 adhered to its top surface.

The platen 100 is attached to the top surface of a rotary member 110 rotatably attached to a central shaft 111 through a bearing 112. This is designed to rotate integrally with the rotary member 110 by making the rotary member 110 rotate by a motor or other drive source 130.

In this CMP apparatus, a wafer 200 is placed as a workpiece on such a platen 100, the wafer 200 is pressed against it by a carrier 210, and the platen is made to rotate while supplying a polishing solution so as to polish the wafer 200.

Specifically, the carrier 210 presses the wafer 200 on the carrier 100 through a backing pad 211 attached to its bottom surface. The platen 100 and the carrier 210 are made to rotate in this state in the same direction at the same rotational speed. At this time, the carrier 210 is made to oscillate in the diametrical direction of the platen 100.

Further, in such a CMP apparatus, a laser sensor 300 is provided for measuring the state of polish of the wafer 200.

That is, a small diameter hole 120 is made passing through the polishing pad 101, the platen 100, and the rotary member 110. The laser sensor 300 is disposed under this hole 120. Due to this, when the hole 120 comes directly above the laser sensor 300 when the platen 100 is rotating, a laser beam is fired from the laser sensor 300 toward the hole 120 and measures the state of polish of the wafer 200 over the hole 120.

In such a polishing apparatus of the related art explained above, however, there were the following problems.

If the wafer 200 continues being polished, as shown in FIG. 11, the approximately center portion of the polishing pad 101 ends up becoming worn more than the inner peripheral portion or the outer peripheral portion.

That is, uneven wear occurs in the polishing pad 101. Each time, it is necessary to stop the CMP apparatus and dress the inner peripheral portion or outer peripheral portion to reduce them to the thickness of the center portion or to change the polishing pad 101. Therefore, the CMP apparatus had to be stopped for a long period and the operating rate of the apparatus was extremely poor.

Further, it is necessary to actuate the laser sensor 300 when the rotating hole 120 comes directly above the laser sensor 300, so the control of the timing is extremely difficult. In particular, the wafer 200 oscillates in the diametrical direction of the platen 100, so when the hole 120 arrives directly above the laser sensor 300, it is necessary to control the oscillation of the carrier 210 so that the center portion or peripheral edge portion of the wafer 200 was positioned directly above the hole 120. Control of this was difficult. Therefore, it was not possible to accurately measure the state of polish of the wafer 200.

Further, there were cases where laser measurement became no longer possible due to the polishing solution accumulating in the small hole 120.

SUMMARY OF THE INVENTION

The present invention was made to solve the above problems and has as its object to provide a polishing apparatus designed to prevent uneven wear of the platen and improve the operating rate of the apparatus.

To achieve this object, according to a first aspect of the present invention, there is provided a polishing apparatus comprising: a rotating platen; and a pressing member for making the workpiece oscillate in the diametrical direction of the platen while pressing it against the platen, wherein the platen is divided into an inner peripheral platen portion and a donut-shaped outer peripheral platen portion arranged concentrically and capable of rotating independently.

Due to this configuration, if the inner peripheral platen portion and the outer peripheral platen portion are made to rotate in opposite directions and the workpiece is made to oscillate while being pressed against these inner peripheral platen portion and outer peripheral platen portion by the pressing member, the workpiece is polished by these inner peripheral platen portion and outer peripheral platen portion. At this time, it is possible to adjust the rotational speeds of the inner peripheral platen portion and the outer peripheral platen portion to adjust the amounts of wear of the inner peripheral platen portion and outer peripheral platen portion.

Further, according to the aspect of the invention, the inner peripheral platen portion and the outer peripheral platen portion are made to rotate in opposite directions.

Due to this configuration, it is possible to make the amount of wear of the inner peripheral platen portion and the amount of wear of the outer peripheral platen portion substantially equal.

Further, according to the aspect of the invention, rotational speeds of the inner peripheral platen portion and outer peripheral platen portion are set so that the mean relative speed between the workpiece and inner peripheral platen portion and the mean relative speed between the workpiece and the outer peripheral platen portion become substantially the same.

Due to this configuration, it is possible to improve the uniformity of the amounts of wear of the inner peripheral platen portion and outer peripheral platen portion.

Further, according to the aspect of the invention, the inner peripheral platen portion is formed into a donut shape and the workpiece is made to overhang so that part of the workpiece protrudes out from the inner edge of the inner peripheral platen portion and the outer edge of the outer peripheral platen portion.

Due to this configuration, the amounts of wear of the inner peripheral portion of the inner peripheral platen portion and the outer peripheral portion of the outer peripheral platen portion change in accordance with the amounts of overhang of the workpiece, so by adjusting the amounts of overhang of the workpiece, it is possible to make the amounts of wear of the inner peripheral portion and outer peripheral portion of platen as a whole equal to a considerable accuracy.

Further, according to the aspect of the invention, there is provided a polishing apparatus further comprising: a first measuring device arranged at a position peeking through a gap between the inner peripheral platen portion and the outer peripheral platen portion and at a position over which the center portion of the polishing surface of the workpiece passes and measuring the state of polish of the vicinity of the center portion of the polishing surface; and a second measuring device arranged at a position peeking through a gap between the inner peripheral platen portion and the outer peripheral platen portion and at a position over which the outer peripheral portion of the polishing surface of the workpiece passes and measuring the state of polish of the outer peripheral portion of the polishing surface.

Due to this configuration, it is possible to measure the state of polish of the vicinity of the center portion of the workpiece by the first measuring device except for the gap between the inner peripheral platen portion and the outer peripheral platen portion and possible to measure the state of polish of the outer peripheral portion of the workpiece by the second measuring device.

BRIEF DESCRIPTION OF THE DRAWINGS

The above and other objects, features, and advantages of the present invention will become more readily apparent from the following description of presently preferred embodiments of the invention taken in conjunction with the accompanying drawings, in which.

DESCRIPTION OF THE PREFERRED EMBODIMENTS

Preferred embodiments of the present invention will be explained below with reference to the drawings.

(First Embodiment)

Figure 1:
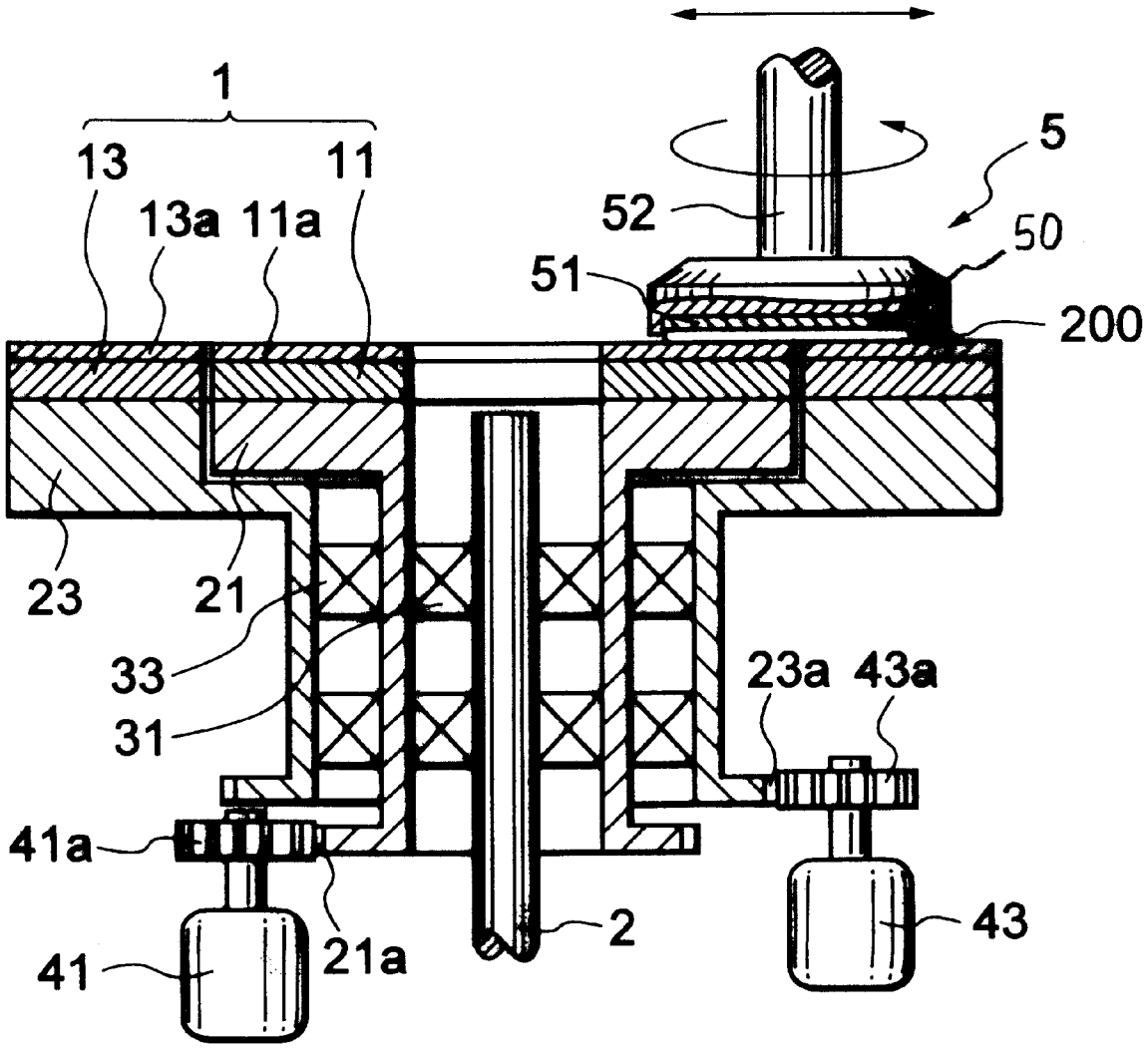
FIG. 1 is a sectional view of a polishing apparatus according to a first embodiment of the present invention.

FIG. 1 is a sectional view of a polishing apparatus according to a first embodiment of the present invention.

This polishing apparatus is a CMP apparatus provided with a platen 1 and a carrier 5 serving as a pressing member.

The platen 1 is split into two into an inner peripheral platen portion 11 and an outer peripheral platen portion 13. The inner peripheral platen portion 11 and the outer peripheral platen portion 13 are respectively attached to the upper surfaces of the rotary members 21 and 23.

Specifically, the rotary member 21 is rotatably attached through a bearing 31 to a center shaft 2. The rotary member 23 is rotatably attached through a bearing 33 to the outside of the rotary member 21.

At the bottom portions of the rotary members 21 and 23 are formed tooth portions 21*a* and 23*a* . The tooth portions 21*a* and 23*a* are engaged with gearwheels 41*a* and 43*a* attached to the shafts of drive portions 41 and 43 and drive the drive portions 41 and 43 so that the rotary members 21 and 22 rotate in opposite directions around the center shaft 2.

The top portions of the rotary members 21 and 23 are formed into ring shapes. The widths of the top portions are set substantially equal.

The inner peripheral platen portion 11 and the outer peripheral platen portion 13 are detachably attached to the top surfaces of these top portions.

The inner peripheral platen portion 11 is a ring member having the same width as the top portion of the rotary member 21 and is provided on its surface with a polishing pad 11*a*. Similarly, the outer peripheral platen portion 13 is also a ring member of the same width as the top portion of the rotary member 23 and is also provided on its surface with a polishing pad 13*a*.

That is, the inner peripheral platen portion 11 and the outer peripheral platen portion 13 having the polishing pads 11*a* and 13*a* are set to substantially equal widths, are arranged concentrically about the center shaft 2, and are rotated independently in opposite directions by the drive portions 41 and 43.

Figure 2:
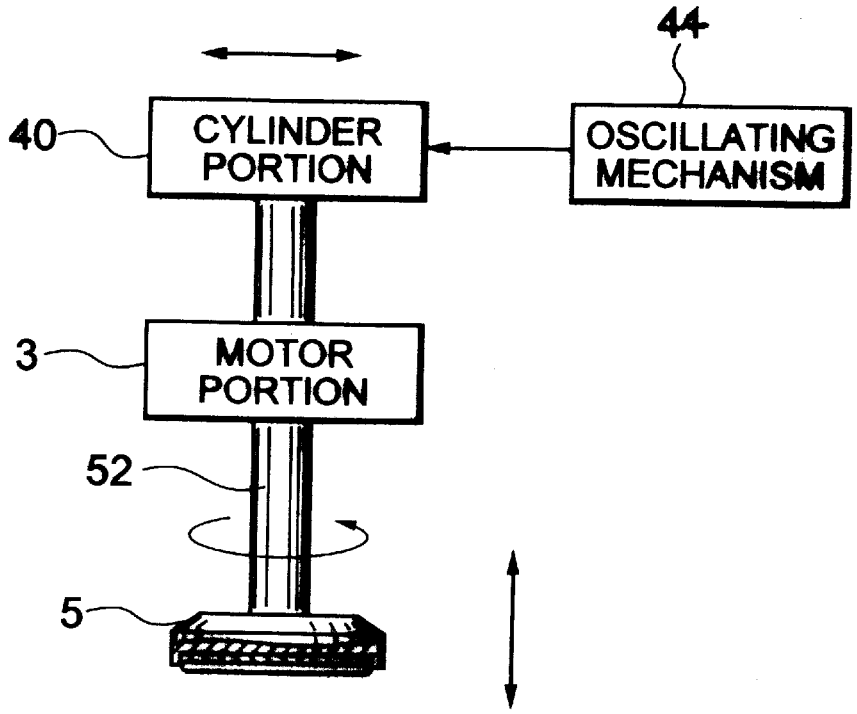
FIG. 2 is a block diagram of the drive configuration of the carrier.

On the other hand, the carrier 5 has at its bottom surface a workpiece holding hole 50 to which a backing pad 51 is attached. The upper surface of the carrier 5 is provided with a rod 52. The upper end of the rod 52 is connected to a motor portion 3, as shown in FIG. 2. The carrier 5 is designed to rotate by being driven by a motor portion 3. The motor portion 3 is connected to a cylinder portion 40. The carrier 5 is able to be raised and lowered through the motor portion 3 by the cylinder portion 40. Further, the cylinder portion 40 is connected to an oscillating mechanism 44. Due to this oscillating mechanism 44, it is possible for the cylinder portion 40, motor portion 3, and carrier 5 as a whole to oscillate in the left-right direction of FIG. 2.

Next, an explanation will be made of the operation of the polishing apparatus of this embodiment.

As shown in FIG. 1, in the state of the wafer 200 being held by the carrier 5, the cylinder portion 40 is made to operate to push the carrier 5 in the downward direction while making the carrier 5 rotate by the motor portion 3 shown in FIG. 2. In this state, if the oscillating mechanism 44 is made to operate to make the carrier 5 oscillate in the diametrical direction of the platen 1, that is, the left-right direction of FIG. 1, the platen 1 is oscillated while rotating in the state pressing against the wafer 200.

In parallel with this operation, the inner peripheral platen portion 11 and the outer peripheral platen portion 13 of the platen 1 are made to rotate in opposite directions by the drive portions 41 and 43 while a not shown polishing solution is being supplied.

At this time, the rotational speeds of the inner peripheral platen portion 11 and the outer peripheral platen portion 13 are set so that the mean relative speed between the wafer 200 and the inner peripheral platen portion 11 and the mean relative speed between the wafer 200 and the outer peripheral platen portion 13 become substantially equal.

Figure 3:
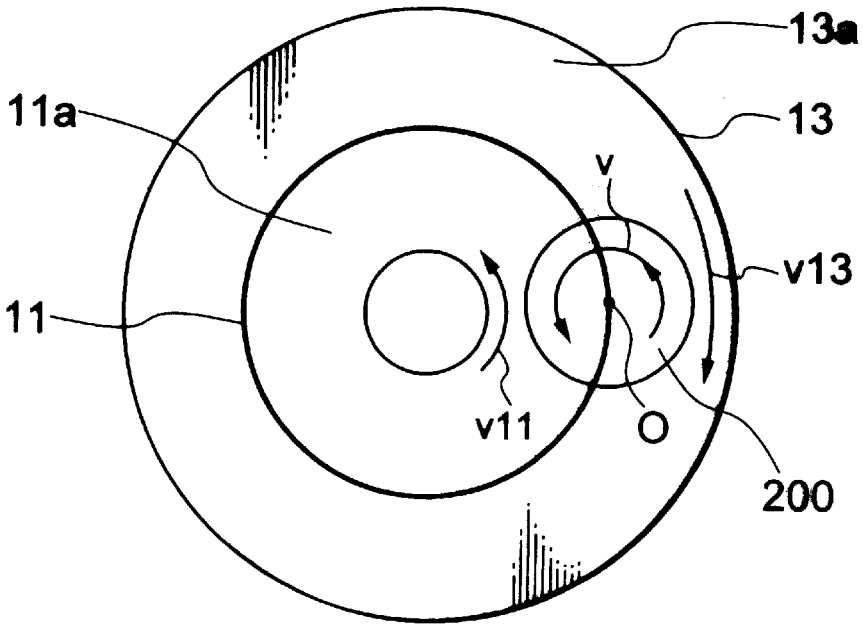
FIG. 3 is a plan view of the directions of rotation of the wafer, the inner peripheral platen portion, and the outer peripheral platen portion.
Figure 4:
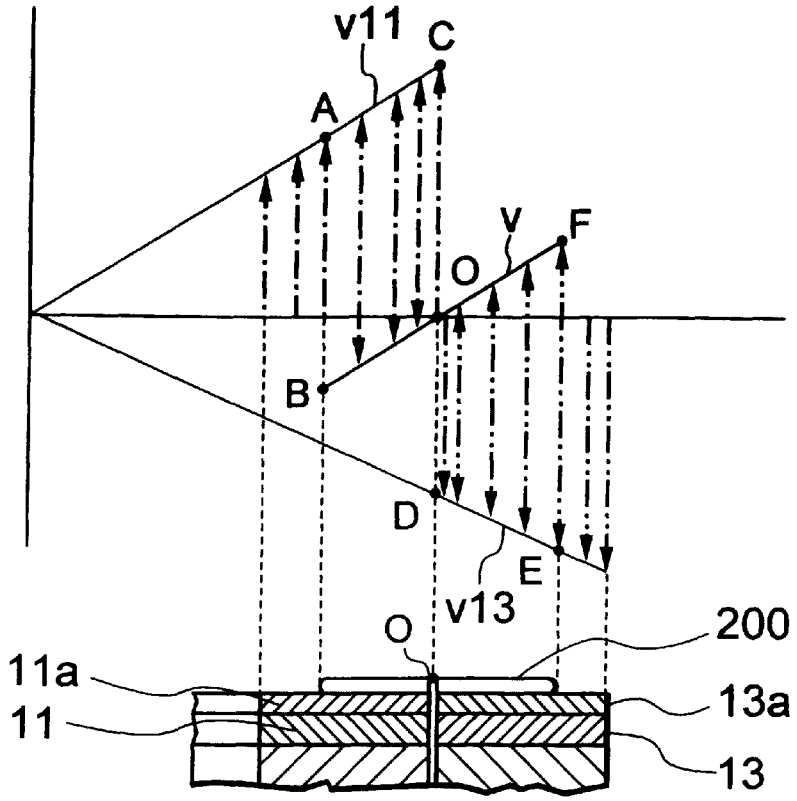
FIG. 4 is a view of the distribution of the rotational speeds in the diametrical direction of the wafer, the inner peripheral platen portion, and the outer peripheral platen portion.

FIG. 3 is a plan view of the directions of rotation of the wafer 200, the inner peripheral platen portion 11, and the outer peripheral platen portion 13; while FIG. 4 is a view of the distribution of the rotational speeds in the diametrical direction of the wafer 200, the inner peripheral platen portion 11, and the outer peripheral platen portion 13.

As shown in FIG. 3, if the wafer 200 and the inner peripheral platen portion 11 rotate counter-clockwise and the outer peripheral platen portion 13 rotate clockwise, the distribution of the rotational speeds in the diametrical direction of the wafer 200, inner peripheral platen portion 11, and outer peripheral platen portion 13 become as shown in FIG. 4.

Specifically, the distribution of the rotational speed v of the wafer 200 when the center 0 of the wafer 200 is at the boundary between the inner peripheral platen portion 11 and the outer peripheral platen portion 13 becomes as shown by the solid line arrow of FIG. 4. Note that the upward facing arrows of FIG. 4 show the magnitudes of the rotational speeds when the different points of the wafer 200 move upward in FIG. 3, while the downward facing arrows of FIG. 4 show the magnitudes of the rotational speeds when the points of the wafer 200 move downward in FIG. 3.

Further, the distribution of the rotational speed v11 of the inner peripheral platen portion 11 is shown by the group of upward-facing arrows, i.e., increase from the inner edge toward the outer edge of the inner peripheral platen portion 11 as shown by the one-dot-dash line arrows of FIG. 4, while the distribution of the rotational speed v13 of the outer peripheral platen portion 13 is shown by the group of downward-facing arrows, i.e., increase from the inner edge toward the outer edge of the outer peripheral platen portion 13 as shown by the two-dot-dash line arrows of FIG. 4.

Therefore, the rotational speed v11 of the inner peripheral platen portion 11 is adjusted to make the quadrangle surrounded by the points ABOC of FIG. 4 become a substantial parallelogram. Due to this, the relative speed between the rotational speed v of the wafer 200 and the rotational speed v11 of the inner peripheral platen portion 11 becomes substantially equal at all points and relative speeds of the points substantially match with the overall mean relative speed <v11>.

On the other hand, the relative speed between the rotational speed v of the wafer 200 and the rotational speed v13 of the outer peripheral platen portion 13 increases from the center 0 to the outer edge of the wafer 200 as shown by the trapezoid surrounded by the points ODEF. Therefore, the rotational speed v13 of the outer peripheral platen portion 13 is adjusted to set the mean rotational speed <v13>of the total relative speed surrounded by the trapezoid to become substantially equal with the above mean relative speed <v11>.

By making the mean relative speed <v11>of the wafer 200 and inner peripheral platen portion 11 and the mean relative speed <v13>of the wafer 200 and outer peripheral platen portion 13 substantially equal, the amount of wear per unit time of the polishing pad 11*a* of the inner peripheral platen portion 11 and the amount of wear per unit time of the polishing pad 13*a* of the outer peripheral platen portion 13 become substantially equal.

Therefore, by making the carrier 5 oscillate in the diametrical direction of the platen 1 under these conditions, the polishing pad 11*a* of the inner peripheral platen portion 11 and the polishing pad 13*a* of the outer peripheral platen portion 13 are worn substantially uniformly, so it is possible to prevent uneven wear to a considerable extent.

(Second Embodiment)

Next, an explanation will be given of a polishing apparatus according to a second embodiment of the present invention.

Figure 5:
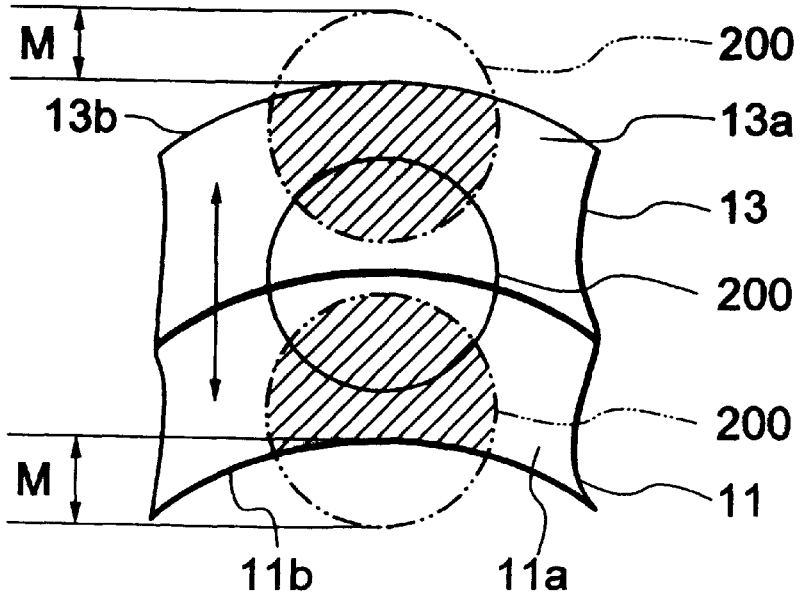
FIG. 5 is a plan view of the state of overhang of the wafer.

This embodiment differs from the above first embodiment in that, as shown in FIG. 5, the extent of oscillation of the wafer 200 is increased by the oscillating mechanism 44 and the wafer 200 is made to overhang the inner peripheral platen portion 11 and the outer peripheral platen portion 13 of the platen 1 by exactly predetermined distances.

If uneven wear occurs in the platen 1, the inner peripheral portion side of the polishing pad 11*a* of the inner peripheral platen portion 11 and the outer peripheral portion side of the polishing pad 13*a* of the outer peripheral platen portion 13 remain thicker than other portions.

If the force of F from above acts on the wafer 200 contacting the polishing pads 11*a* and 13*a* , the pressing force applied to the polishing pads 11*a* and 13*a* through the wafer 200 becomes the force F divided by the area of contact of the wafer 200. Therefore, the smaller the area of contact of the wafer 200 with the polishing pads 11*a* and 13*a* , the greater the pressing force applied to the polishing pads 11*a* and 13*a* . Further, by the wafer 200 rocking from the center of the platen 1 to the inner edge portion 11*b* side of the inner peripheral platen portion 11 and the outer edge portion 13*b* side of the outer peripheral platen portion 13, the time during which the polishing pads 11*a* and 13*a* slide in contact with the wafer 200 (hereinafter referred to as the "time of sliding contact") changes. Further, the times of sliding contact of the polishing pads 11*a* and 13*a* change depending on the speed of oscillation of the wafer 200.

The present inventor took note of this point and decided to make the wafer 200 overhang the inner edge portion 11*b* of the inner peripheral platen portion 11 and the outer edge portion 13*b* of the outer peripheral platen portion 13 as shown by the two-dot-dash line of FIG. 5.

That is, the area of contact of the wafer 200 falls and the times of sliding contact of the inner edge portions 11*b* and 13*b* of the polishing pads 11*a* and 13*a* increase as shown by the hatching in accordance with an increase in the amount of overhang M of the wafer 200. Therefore, when the wafer 200 is positioned at the center portion, the pressing forces applied through the wafer 200 to the polishing pads 11*a* and 13*a* and the times of sliding contact of the inner edge portions 11*b* and 13*b* sides become smallest. Further, the pressing forces applied to the polishing pads 11*a* and 13*a* and the times of sliding contact of the inner edge portions 11*b* and 13*b* become larger as the wafer 200 moves away from the center portion. The amounts of wear of the polishing pads 11*a* and 13*a* are believed to correspond to the pressing forces applied and the times of sliding contact, so as explained above changes in the pressing forces applied to the polishing pads 11*a* and 13*a* and the times of sliding contact of the different portions of the polishing pads 11*a* and 13*a* contribute to uniformity of wear of the polishing pads 11*a* and 13*a*. The contribution of these parameters to the amounts of wear of the polishing pads 11*a* and 13*a*, however, differs depending on the magnitude of the sliding speed of the wafer 200.

Accordingly, depending on the amount of overhang M of the wafer 200 and the sliding speed of the wafer 200, the situation will occur where the amounts of wear of the inner peripheral portion of the polishing pad 11*a* and the outer peripheral portion of the polishing pad 13*a* become too large or too small compared with the amounts of wear of the center portions. Therefore, a dummy inner peripheral platen portion 11 and outer peripheral platen portion 13 and wafer 200 are used in advance to determine the optimum amount of overhang M of the wafer 200 and the sliding speed of the wafer 200 giving substantially even amounts of wear of the polishing pads 11*a* and 13*a*.

Due to this, if the oscillating mechanism 44 is driven, the wafer 200 will overhang by exactly the optimal amount of overhang M while oscillating at a desired oscillation speed and a high precision uniformity of wear in the width direction of the platen 1 will be achieved. As a result, it is possible to further improve the prevention of uneven wear of the platen 1.

Figure 6A:
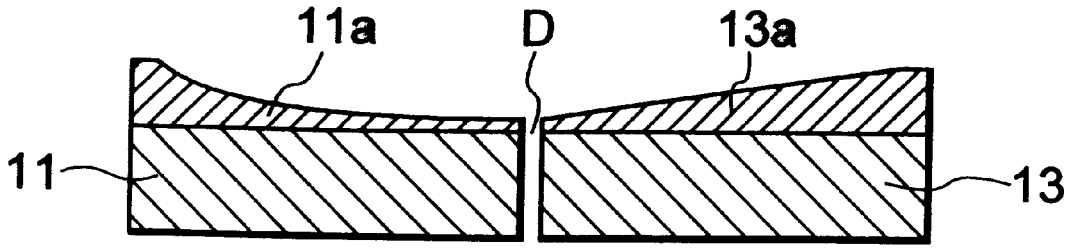
FIGS. 6A to 6C are sectional views of the state of polish of the polishing pad.

That is, when the outer peripheral platen portion 13 rotates in the same direction as the inner peripheral platen portion 11 in FIG. 3, the relative speed of the inner peripheral platen portion 11 with respect to the wafer 200 will become larger than the relative speed of the outer peripheral platen portion 13. Therefore, as shown in FIG. 6A, the sectional shape of the wear of the polishing pad 11*a* of the inner peripheral platen portion 11 and the sectional shape of the wear of the polishing pad 13*a* of the outer peripheral platen portion 13 may not become symmetrical with respect to the gap D.

Figure 6B:
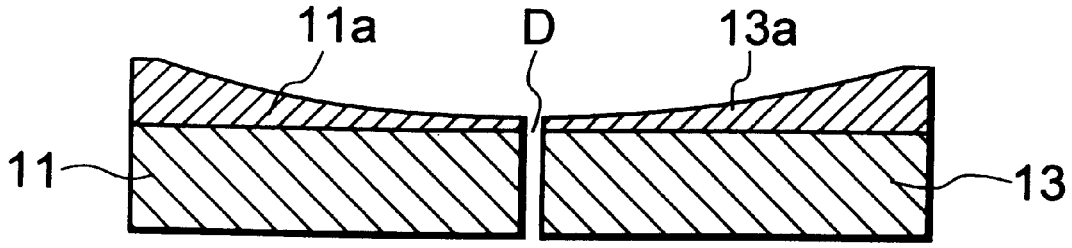

Accordingly, in this embodiment, as shown in FIG. 3, by making the directions of rotation of the inner peripheral platen portion 11 and the outer peripheral platen portion 13 different, as shown in FIG. 6B, the sectional shapes of the wear of the polishing pads 11*a* and 13*a* of the inner peripheral platen portion 11 and the outer peripheral platen portion 13 become substantially symmetrical about the gap D.

Figure 6C:
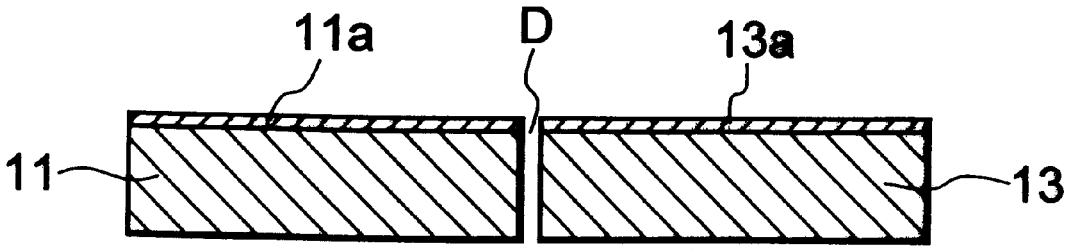

Further, by driving the oscillating mechanism 44 to make the wafer 200 overhang by exactly the optimum amount of overhang M, as shown by FIG. 6C, the inner peripheral portion side of the polishing pad 11*a* and the outer peripheral portion side of the polishing pad 13*a* are uniformly worn.

The rest of the configuration and the mode of operation and advantageous effects are similar to those of the first embodiment explained above, so will not be explained here.

(Third Embodiment)

Figure 7:
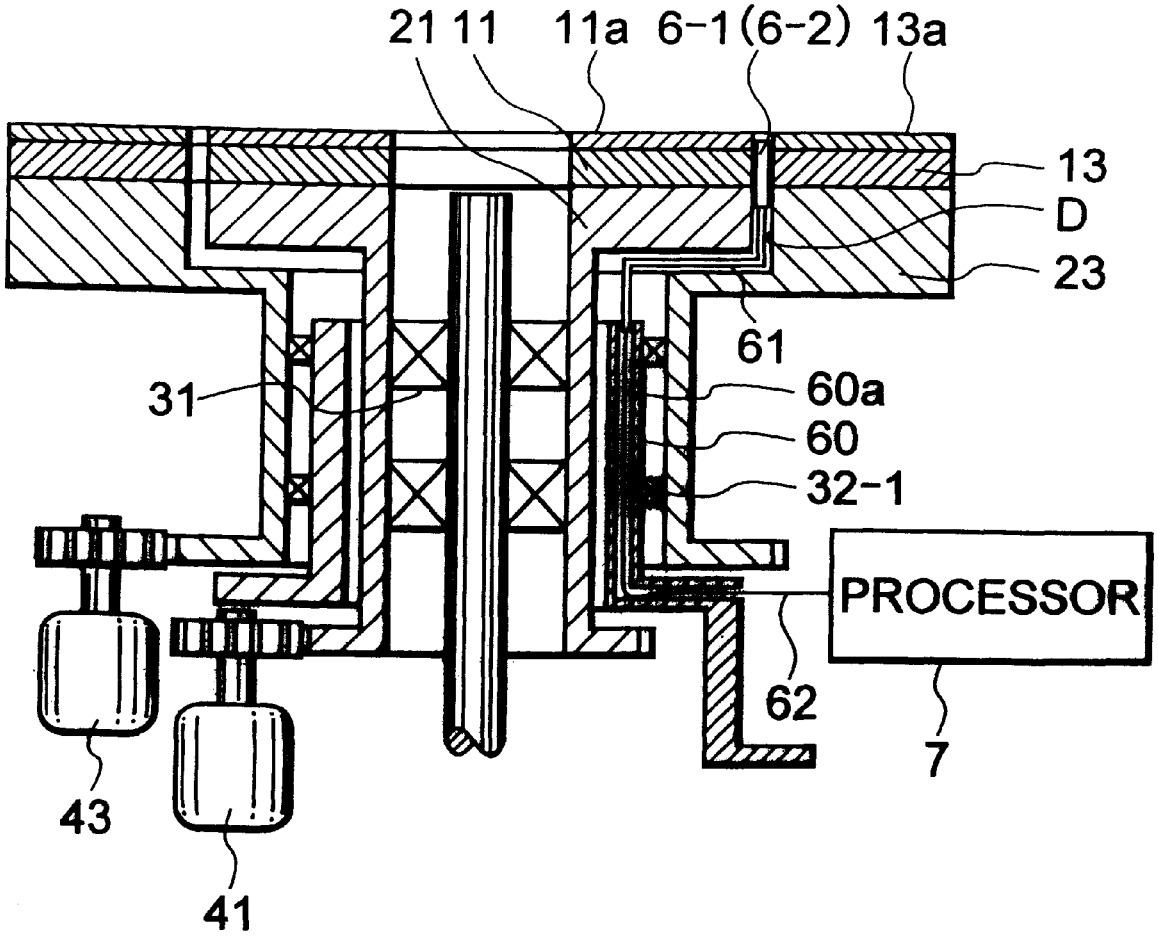
FIG. 7 is a sectional view of a CMP apparatus according to a third embodiment of the present invention.

FIG. 7 is a sectional view of a CMP apparatus according to a third embodiment of the present invention.

This CMP apparatus is provided with a laser sensor 6-1 serving as the first measuring device, a laser sensor 6-2 serving as the second measuring device, and a processor 7. The point of difference from the first and second embodiments is that the apparatus is structured to enable measurement of the state of polish of the polishing surface of the wafer 200 by these.

The laser sensor 6-1 (6-2) is positioned in the gap D between the inner peripheral platen portion 11 and the outer peripheral platen portion 13.

Specifically, a fixing member 60 is affixed at the outside of the rotary member 21. The rotary member 23 is rotatably attached to the outside of the fixing member 60 through a bearing 32-1.

The laser sensor 6-1 (6-2) is arranged in the gap D so as not to contact the inner peripheral platen portion 11 and outer peripheral platen portion 13, is connected to the upper end of the fixing member 60, and is held at the upper end of a hard thin tube 61 bent along the gap between the rotary members 21 and 23.

The thus positioned laser sensor 6-1 (6-2) is a known device which fires a laser beam to the wafer 200 to measure the distance to the wafer 200 and outputs a signal showing the measured value to the processor 7. A conductor 62 is passed through the thin tube 61 and a hole 60*a* in the fixing member 60, is led out from the bottom of the fixing member 60, and is connected to the processor 7.

The two laser sensors 6-1 and 6-2 are arranged at predetermined locations in the ring-shaped gap D.

Figure 8:
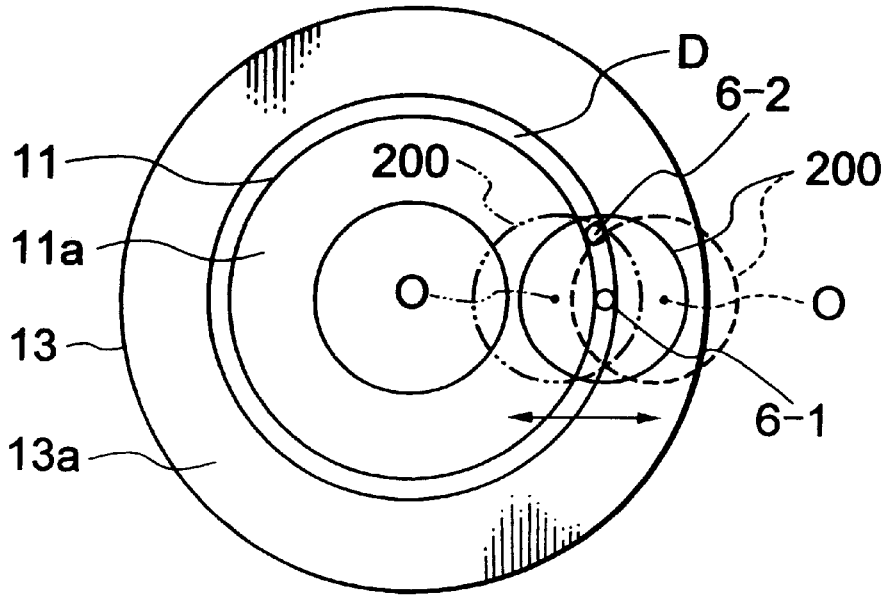
FIG. 8 is a plan view of the state of arrangement of the laser sensors.

Specifically, as shown in FIG. 8, the laser sensor 6-1 is arranged at a position over which the center portion of the rotating and oscillating wafer 200 passes, while the laser sensor 6-2 is arranged at a position over which the outer peripheral portion of the wafer 200 passes.

On the other hand, the processor 7 is a known device which can calculate the flatness or uniformity of the wafer 200 based on the measured values of the distance shown by the signals from the laser sensors 61 and 6-2.

Next, an explanation will be given of the operation of the CMP apparatus of this embodiment.

As shown in FIG. 8, if the wafer 200 oscillates in the arrow direction while rotating, the distance to the wafer 200 directly above which the laser 6-1 passes is continually measured, the signal is sent to the processor 7, and the thickness of the portion directly above which the laser sensor 6-1 passes is calculated by the processor 7.

Figure 9:
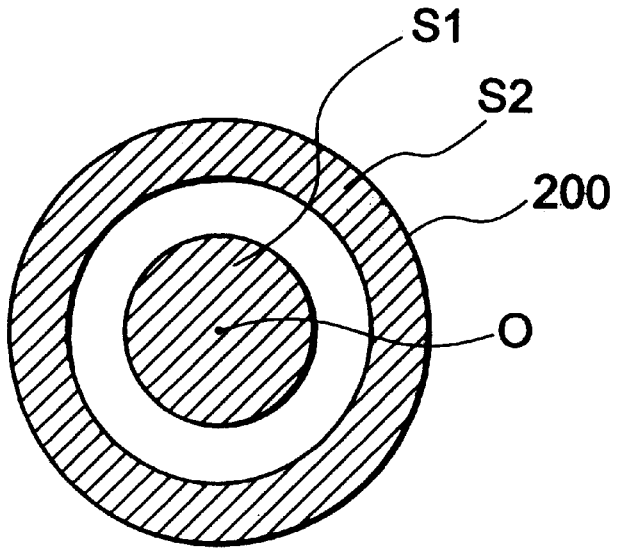
FIG. 9 is a plan view of the measurement regions of the laser sensors.
Figure 10:
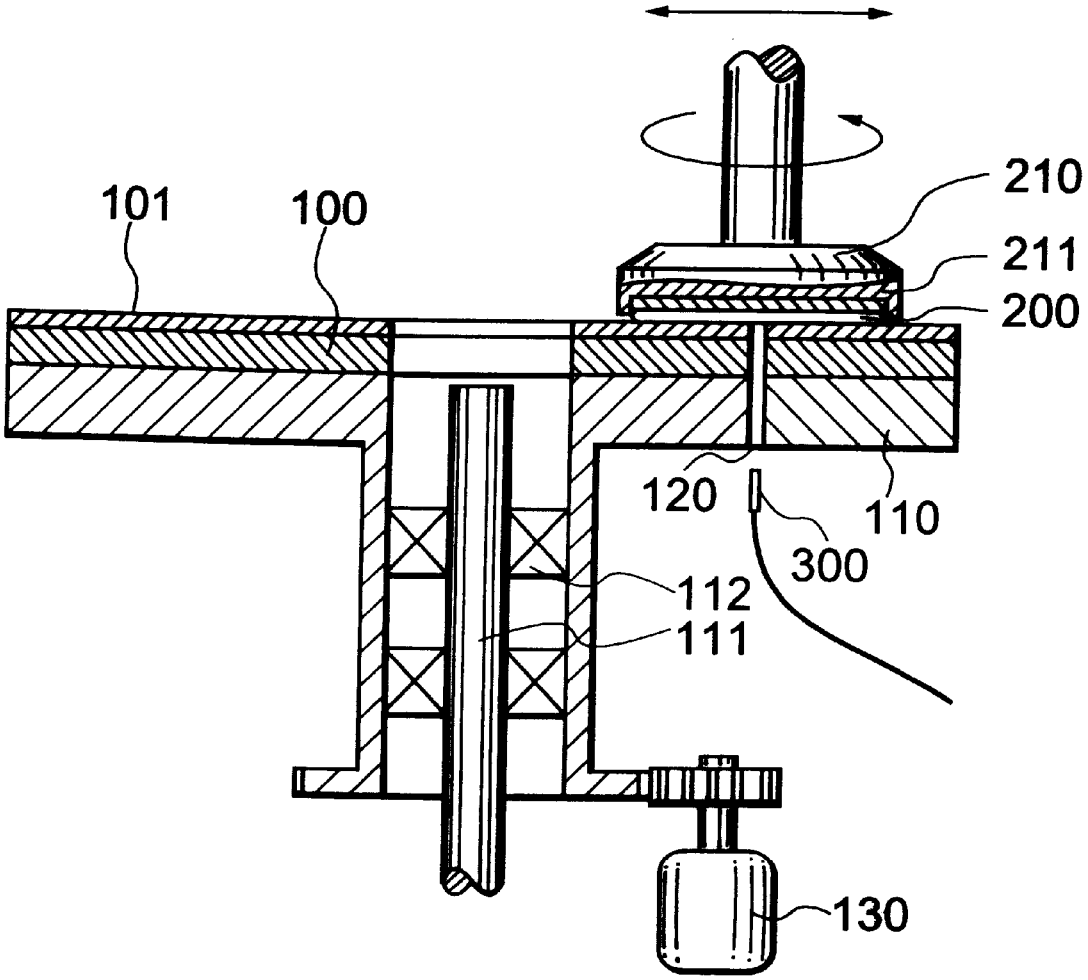
FIG. 10 PRIOR ART
FIG. 10 is a sectional view of a CMP apparatus of the related art.
Figure 11:
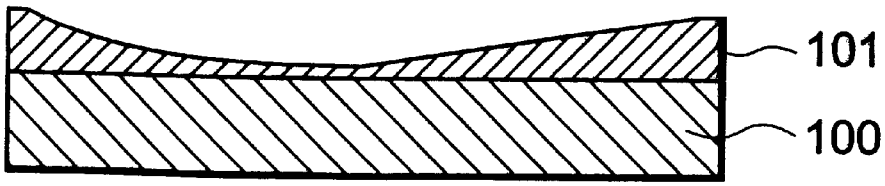
FIG. 11 PRIOR ART
FIG. 11 is a sectional view of the uneven state of polish of the polishing pad.

Since however the wafer 200 repeatedly oscillates while rotating, at the laser sensor 6-1, as shown in FIG. 9, the distance to the circular region S1 near the center portion O of the wafer with a diameter equal to the distance of oscillation is measured and the thickness of the region S1 is calculated by the processor 7.

Further, at the laser sensor 6-2, the outer peripheral portion of the wafer 200 is measured. Since the wafer 200 repeatedly oscillates while rotating, the thickness of the ring-shaped region S2 of the outer peripheral portion of the wafer 200 is measured. Therefore, in this embodiment, the distance of oscillation of the wafer 200 is increased and the position of the laser sensor 6-2 made close to the center point O of the wafer 200 so as to enable measurement of substantially the entire surface of the wafer 200.

Further, it is possible to determine the uniformity of the bottom surface of the wafer 200 and simultaneously determine the recessed or projecting state of the polishing shown by the state of machining from the measured value of the laser sensor 6-1 minus the measured value of the laser sensor 6-2. That is, when the result of the subtraction is a positive value, the bottom surface of the wafer 200 is projecting, while when it is a negative value, it is recessed.

In this way, according to the CMP apparatus of this embodiment, there is no need to consider the timing of operation of the laser sensors 6-1 and 6-2, so it is possible to measure the flatness or uniformity of the wafer 200 with a high precision by simple control of measurement.

Further, since the gap D is not a small hole, but ring shaped, it is possible to prevent a situation where the polishing solution accumulates in the gap D and makes measurement by the laser sensors 6-1 and 6-2 impossible.

The rest of the configuration and the mode of operation and advantageous effects are similar to those f the first embodiment and second embodiment explained above, so will not be explained here.

In the above embodiments, the explanation was made with reference to a CMP apparatus, but the invention may be applied to other apparatuses as well. For example, a similar mode of operation and advantageous effects as a CMP apparatus of the above embodiments can be obtained by dividing the bottom platen into two in a one-side lapping apparatus by making a bottom platen rotate while pressing the workpiece against the bottom platen to polish it by a head serving as a pressing member. Further, a similar mode of operation and advantageous effects can be obtained by dividing the bottom platen into two in a one-side polishing apparatus for mechanically giving a mirror polish to a workpiece by a head serving as a pressing member and a bottom platen to which a polishing pad is attached.

Further, in the above embodiments, the inner peripheral platen portion 11 and the outer peripheral platen portion 13 were set to the same widths, but this does not mean that setting them at different widths is excluded.

Further, in the above embodiments, the laser sensors 6-1 and 6-2 were used as measuring devices, but it is sufficient that the sensor can measure the thickness etc. of the wafer 200 and, for example, it is also possible to use a sensor which can measure the thickness of the wafer 200 by firing incandescent light.

Summarizing the advantageous effects of the present invention, as explained in detail above, according to the polishing apparatus according to the aspect of the invention, it is possible to make the amount of wear of the inner peripheral platen portion as a whole and the amount of wear of the outer peripheral platen portion as a whole substantially the same, so there are the superior advantageous effects that it is possible to prevent uneven amount of wear of the platen as a whole comprised of the inner peripheral platen portion and the outer peripheral platen portion and as a result it is possible to lengthen the service life of the platen and possible to improve the operating rate of the apparatus. Further, since the platen is divided into the inner peripheral platen portion and the outer peripheral platen portion, the work of replacing the platen consists simply of replacing the light inner peripheral platen portion and outer peripheral platen portion. As a result, it is possible to easily and quickly perform the work for replacing the platen and possible to shorten the time for replacing the platen. Accordingly, from this sense as well, it is possible to improve the operating rate of the apparatus. Further, it is possible to use the apparatus as a conventional polishing apparatus as well by making the inner peripheral platen portion and the outer peripheral platen portion at the same speed in the same direction.

Further, according to the polishing apparatus according to the aspect of the invention, it is possible to make the amounts of wear of the inner peripheral portion and outer peripheral portion of the platen as a whole equal by a precision corresponding to the amount of wear of the center portion by adjusting the amount of overhang of the workpiece, so it is possible to further improve the prevention of uneven wear.

Further, according to the polishing apparatus according to the aspect of the invention, it is possible to measure the state of polish of substantially the entire polishing surface of the workpiece, so high precision measurement becomes possible.

What is claimed is:

1. A polishing apparatus comprising:

a rotating platen; and a pressing member for making the workpiece oscillate in the diametrical direction of said platen while pressing it against the platen;

wherein said platen is divided into an inner peripheral platen portion and a donut-shaped outer peripheral platen portion arranged concentrically and capable of rotating independently.

2. A polishing apparatus as set forth in claim 1, where said inner peripheral platen portion and said outer peripheral platen portion are made to rotate in opposite directions.

3. A polishing apparatus as set forth in claim 2, wherein rotational speeds of said inner peripheral platen portion and said outer peripheral platen portion are set so that the mean relative speed between the workpiece and said inner peripheral platen portion and the mean relative speed between the workpiece and said outer peripheral platen portion become substantially the same.

4. A polishing apparatus as set forth in claim 1, wherein:

said inner peripheral platen portion is formed into a donut shape, and the workpiece is made to overhang so that part of the workpiece protrudes out from the inner edge of said inner peripheral platen portion and the outer edge of said outer peripheral platen portion.

5. A polishing apparatus as set forth in claim 1, further comprising:

a first measuring device arranged at a position peeking through a gap between said inner peripheral platen portion and said outer peripheral platen portion and at a position over which the center portion of the polishing surface of the workpiece passes and measuring the state of polish of the vicinity of the center portion of the polishing surface; and a second measuring device arranged at a position peeking through a gap between said inner peripheral platen portion and said outer peripheral platen portion and at a position over which the outer peripheral portion of the polishing surface of the workpiece passes and measuring the state of polish of the outer peripheral portion of the polishing surface.

* * * * *